US005090753A

United States Patent [19]

Goodman

[11] Patent Number: 5,090,753

[45] Date of Patent: Feb. 25, 1992

[54] AUTOMATIC LOCKING MECHANISM FOR DUMPSTER LID

[76] Inventor: Lowell R. Goodman, Rt. 1, Box 79T, Chester, Md. 21619

[21] Appl. No.: 559,860

[22] Filed: Jul. 30, 1990

[51] Int. Cl.[5] ..... B65D 45/04; B65D 45/28; E05C 3/00

[52] U.S. Cl. ..... 292/230; 292/205; 220/324; 220/326; 220/346; 220/348; 220/908; 414/411; 294/68.26

[58] Field of Search ..... 220/324, 326, 345, 346, 220/348, 318, 908; 414/411, 414; 294/68.26; 70/159; 292/205, 230, 237

[56] References Cited

U.S. PATENT DOCUMENTS

| | | | |
|---|---|---|---|
| 2,941,690 | 6/1960 | Keys | 220/324 X |
| 3,315,828 | 4/1967 | Dubo | 220/908 X |
| 3,694,016 | 9/1972 | Scallan | 292/205 X |
| 3,709,389 | 1/1973 | Steltz | 414/408 |
| 4,152,979 | 5/1979 | Schmidt | 220/908 X |
| 4,155,584 | 5/1979 | Pracchia | 414/414 X |
| 4,182,530 | 1/1980 | Hodge | 220/908 X |
| 4,290,352 | 9/1981 | Schmidt et al. | 220/908 X |
| 4,334,820 | 6/1982 | Homura | 414/414 X |
| 4,534,488 | 8/1985 | Boggs et al. | 220/323 |
| 4,622,902 | 11/1986 | Miller | 220/324 X |
| 4,739,896 | 4/1988 | Moss | 220/324 X |
| 4,892,218 | 1/1990 | Reiling | 220/908 X |
| 5,015,021 | 5/1991 | Wyson et al. | 414/414 X |
| 5,029,724 | 7/1991 | Serio | 220/908 X |

FOREIGN PATENT DOCUMENTS

| | | | |
|---|---|---|---|
| 3013308 | 10/1981 | Fed. Rep. of Germany | 220/908 |
| 3441886 | 6/1985 | Fed. Rep. of Germany | 220/908 |
| 2412477 | 7/1979 | France | 220/908 |
| 870260 | 10/1981 | U.S.S.R. | 220/908 |

*Primary Examiner*—David A. Bucci
*Assistant Examiner*—Robert S. Katz
*Attorney, Agent, or Firm*—Longacre & White

[57] ABSTRACT

The invention is directed to an automatic locking mechanism for a dumpster container having a hinged lid. The elements of the locking mechanism comprise an L or U-shaped securing member which is attached to one or both sidewalls of the container. The securing member pivots over the lid, and is held in place by a securing mechanism. The securing mechanism fixes the L or U-shaped securing member in a position that inhibits opening of the container lid. The securing mechanism is automatically operated by a spring or gravity operated foot piece and linkage system which pivots the securing member over the lid of the container.

8 Claims, 3 Drawing Sheets

AUTOMATIC LOCKING MECHANISM FOR DUMPSTER LID

FIELD OF THE INVENTION

The present invention relates to the field of automatic locking mechanisms for dumpster container lids. Specifically, the invention relates to a pivoting foot and spring operated mechanism for automatically locking and unlocking the hinged access lid for lidded dumpster containers.

BACKGROUND OF THE INVENTION

Many container lid locking mechanisms have been proposed. An example of a container lid locking system is disclosed in U.S. Pat. No. 4,534,488. While the many container lid locking mechanisms have their uses, several shortcomings have become evident with respect to efficiently and effectively locking lids on large containers. Specifically, in the field of locking container lids for trash receptacles, there are few simple locking mechanisms, and even fewer retrofit automatic mechanisms which can be applied to a broad variety of types and sizes of containers.

With the advent of mechanized trash removal, there have been created a number of large sized trash bins. These bins usually comprise a block shaped container with a hinged lid attached to one side thereof. The container further includes attachments for accommodating various forked lifting mechanisms of the trash removal vehicle. The containers are lifted by the lifting mechanism of the trash removal vehicle and pivoted in some fashion so that the hinged top of the container opens and the trash contained therein is emptied into the vehicle. The container is then returned to a position on the ground, and the hinged lid closes on top of the container.

Many of these large trash receptacles are rented from a trash removal service. These receptacles are not provided free of charge, and consequently their frequent emptying and service can become a considerable expense. This expense is increased when unauthorized users of the receptacle freely deposit trash therein. This unauthorized use necessitates a more frequent emptying of the container, and of course the unauthorized user does not contribute to the increased expense.

For the foregoing reasons, there has existed a need to create a locking mechanism for these containers which is simple and reliable, and which can be originally and retrofitted to a broad variety of containers. While many of these containers are of all metal construction, and at that very fairly heavy gauge metal, many of the newer containers are of partial plastic construction or are of all plastic construction. Hence, the ability for a user or provider of the receptacle to attach a simple welded locking structure is limited owing to the fact that not all of the parts of the container can accommodate a weld.

A device has been proposed in U.S. applications Ser. Nos. 07/465,328, now U.S. Pat. No. 5,029,724 and 07/515,515, now U.S. Pat. No. 5,042,856 which solve many of the shortcomings of the prior art. However, the locking device proposed in the first referenced U.S. application cannot be automatically operated by the mere use of a trash removal vehicle to empty the container. Instead, the vehicle operator must leave the vehicle and unlock a securing chain so as to enable emptying of the container. After the dumping operation is complete, the operator must resecure the locking mechanism in the locked position. While the previously proposed device has advantages with respect to cost efficiency, the lack of automation may be considered a drawback in certain applications of the locking mechanism.

The locking mechanism proposed in the second listed application includes automatic counterweighted operation of a dumpster locking mechanism. As an improvement in the field of automatic locking mechanisms, the present invention proposes to take advantage of the weight of the container and the well established emptying cycle. The weight of the container secures the lock in place, and upon lifting of the container, a spring and/or gravity operated foot unlocks the device and maintains the device in an unlocked configuration during the dumping cycle.

SUMMARY OF THE INVENTION

The present invention seeks to disclose another variation on the automatic locking of containers. The present invention includes a release mechanism attached to a side of the container and spanning the height of the container from the underlying surface to the hinged top of the container. A spring and/or gravity operated foot assembly releases when the container is lifted, and rotates a locking bar away from the position in which it secures the container lid. When the dumping operation is completed, replacing the container to a set position pivots the locking bar back into the locking position.

Owner access to the dumpster is enabled by the removal of a separate locking assembly which disengages the foot to locking bar connection, and allows for independent rotation of the locking bar.

These and other objects of the invention will become apparent to one of skill in this art upon the reading of the following detailed description along with the accompanying drawings which form a part thereof.

DETAILED DESCRIPTION OF THE PREFERRED EMBODIMENT

Figure 1:
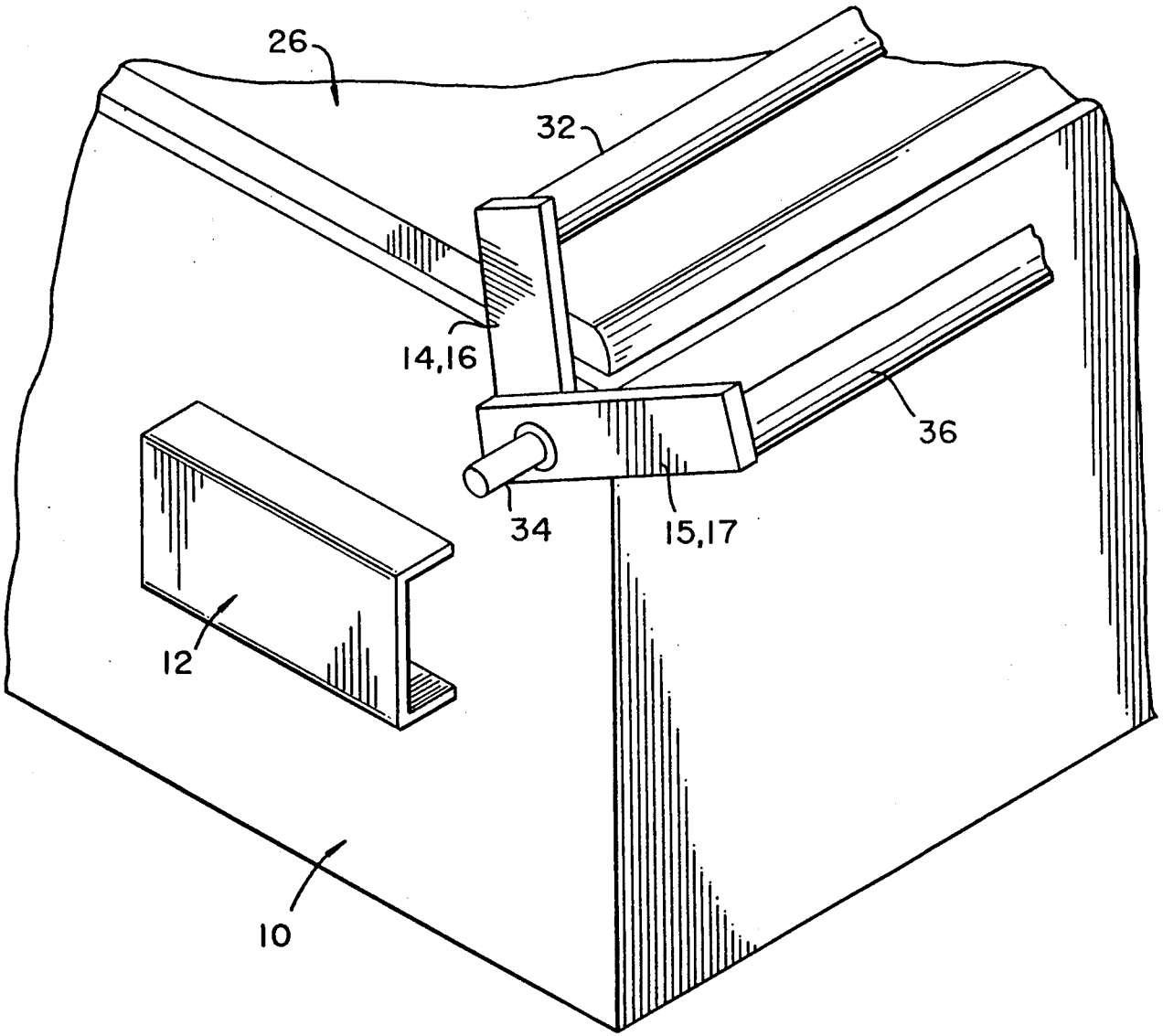
FIG. 1 is a perspective view showing a forward upper corner of the locking bar sub assembly used in the present invention.

FIG. 1 shows a container 10 equipped with a locking mechanism according to the present invention. The container 10 includes a lid 26 which hinges from a rearward portion of the container. The container also includes a pair of lifting sleeves 12 which are attached to each side of the container. To empty the container, a trash removal vehicle engages the respective sleeves 12 on each side of the container with a pair of tines. The vehicle then raises the container in a slowly inverting manner until the container is suspended in a substantially inverted manner over a receiving port in the top of the trash removal vehicle. As the container is inverted, the hinged lid 26 swings open and the contents of the container is allowed to empty.

The locking mechanism according to the present invention includes a pivoting locking means such as locking bar 32 pinned for pivotal motion about pin member 34 which is attached to the sidewall of container 10. The locking bar 32 can typically be L shaped or U shaped depending on whether it is desireable or necessary for the top of the locking bar to extend across the entire top of the container. If an L shaped bar is used, a portion of the L must extend over the lid of the container to inhibit the lid from opening. If a U shaped bar is used (as shown), the bar is pinned for pivotal motion on both sides of the container, with the connecting portion of the U spanning across the lid of the container. Other shapes of locking bars may also be accommodated, so long as the pivoting described herein can be accomplished and the lid of the container can be held closed. In addition, a plurality of locking bars may also be used. The locking bars may be pivoted around one or more pin members 34. A locking bar having an end pinned for rotation from a location along a side span of the container and pivoting over the center of the lid (or lids) and having a branching end piece to cover the lids securely may also be used.

In the embodiment shown, a push bar 36 is attached to the locking bar 32 by a pair of pivot arms 14, 16 (not shown) and 15, 17 (not shown). The respective pivot arms of the push bar and locking bar are attached at an approximate angle of 80 degrees. The entire assembly pivots forward and aft about pins 34 over the hinging lid 26 of the container 10.

Figure 2:
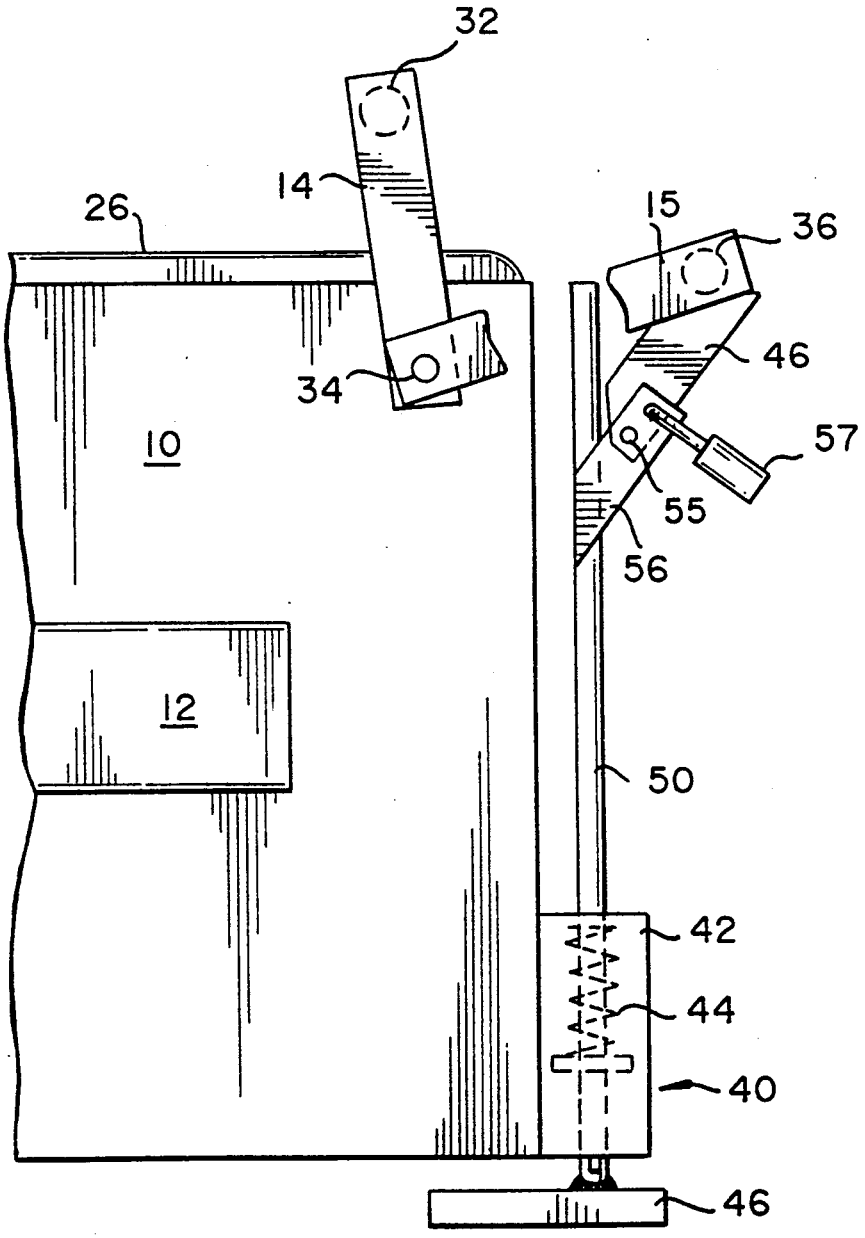
FIG. 2 is a side elevational view of the locking bar and associated spring foot of the present invention.
Figure 3:
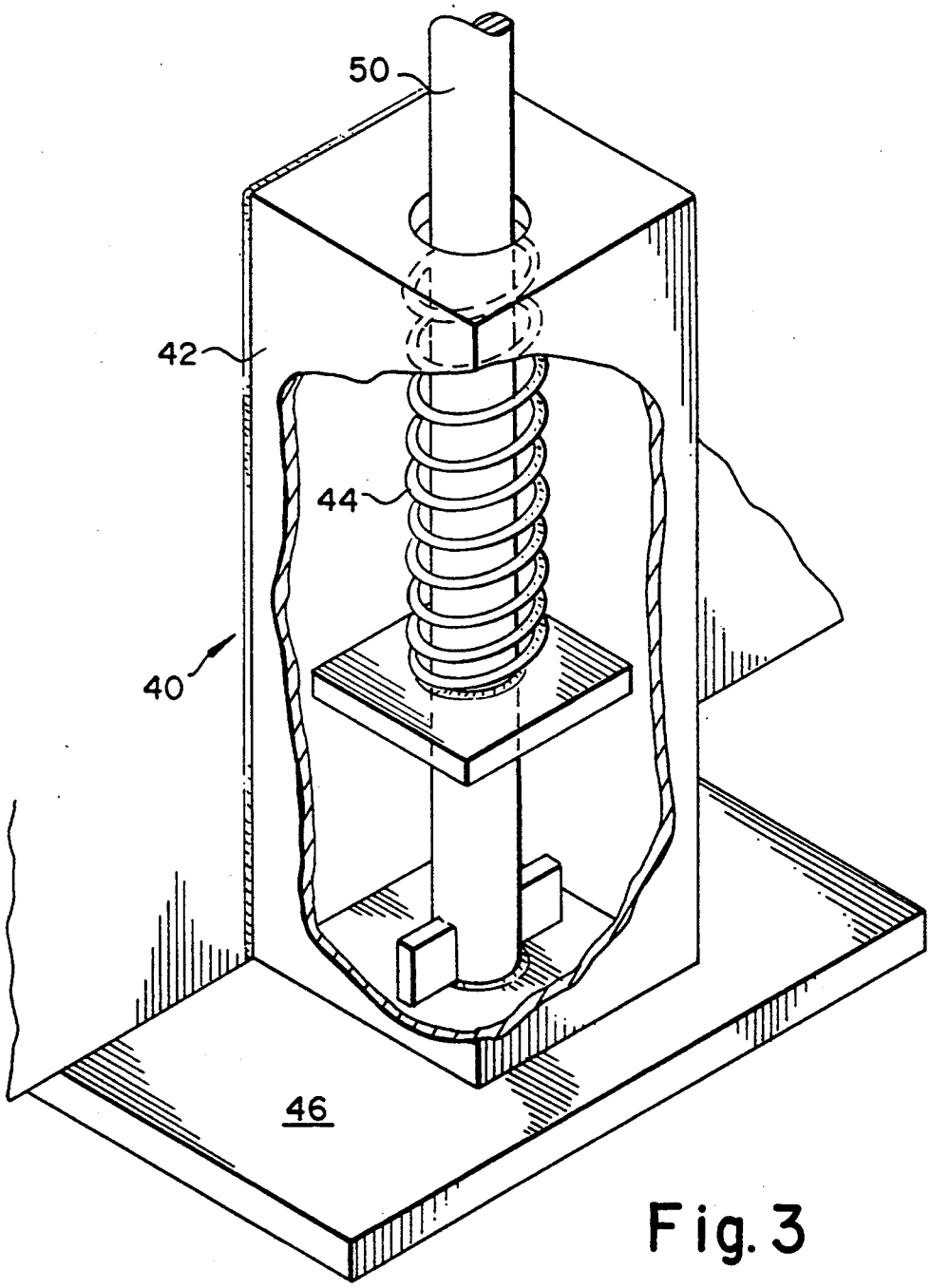
FIG. 3 is a detail view of the spring foot of the present invention.

The locking and unlocking of the locking bar 32 is accomplished by a linkage shown in FIG. 2 which connects between the locking bar 32 and a foot apparatus 40 located near the underlying surface supporting the container. A first link member 46 associated with the push bar 36 is pinned to a second link member 56 which is associated with a foot rod 50. The foot rod 50 is in turn connected to the foot piece 46. The foot apparatus 40 is contained within a supporting casing 42 attached to the side of the container 10. The supporting case 42 includes a spring 44 which urges the foot piece 46 against the underlying surface. Ordinarily, gravity initiates the movement of the foot piece, and a spring is necessary to maintain the locking bar in the unlocked configuration. However, in some configurations of the container, depending on which surface the lid is hinged from, the lid may maintain the bar in an unlocked configuration during the emptying cycle by virtue of bearing against the bar during the cycle.

The operation of the locking mechanism is as follows. As the container is lifted the foot piece 46 is urged downwardly by gravity and/or spring 44. As the foot piece 46 moves downwardly, the foot rod 50 is moved in the same direction. Owing to the pinned connection 55 between the linking members 46, 56, the locking bar 32 is rotated away from the locking configuration, with the push bar 36 brought to a position alongside the container 10.

With the locking bar 32 no longer in position over the container lid 26, the lid may swing free of the container and enable ordinary emptying of the container into another receptacle. As the container is replaced after emptying, the lid 26 swings into a closed position and the container is placed into an upright configuration on a supporting surface. As the container makes contact with the supporting surface, the foot piece 46 urges the foot rod 50 upwardly, which in turn pivots the push and locking bars 36, 32 into a locked configuration. In this manner, the container 10 is resecured without additional input from the truck operator who may back away and proceed to the next station.

For consumer access to the container 10, a padlock (or other lock) member 57 is removed from the linking members 46, 56. With lock removed, the push bar locking bar apparatus may be pivoted into the unlock position and the lid 26 may be raised.

The locking mechanism of the present invention may be fitted to any of the substantially vertical outer surfaces of the container and be linked to the pivoting locking bar. The selected surface for mounting the locking linkage is determined by which upper surfaces of the container have the lids hingedly attached. The object of the locking mechanism is to combine the spring or gravity operated foot apparatus 40 with an overhead pivoting locking bar 32 so that an otherwise locked container may be emptied by an authorized truck. The foot piece 46 and linkage assembly 50, 56, 46, 36, 34 translates either the spring motion 44 or gravity induced motion to the locking bar 32 and maintains the locking bar in the retracted position during dumping.

If a single locking bar is used which is pinned along the span of an upper edge of a side of the container, the swinging lid pivots and can hold the locking bar in the unlocked configuration. When the container is replaced, the foot and linkage return the bar to a locked position over the lid (or lids) of the container.

The locking assembly, and all of the parts thereof, is contemplated as being of all metal construction for use with all metal dumpster containers. However, a variety of stock materials can be used to create the elements of the locking assembly depending on the container to which the mechanism is &o be fitted.

Further variations of the present invention will occur to those skilled in the art, and the claims listed below are not in anyway intended to limit the scope of this invention.

I claim:

1. An automatic pivoting locking mechanism for a dumpster container having a bottom supported by an underlying surface and a top with a hinging lid, said locking mechanism comprising:

a U shaped locking bar pivotally attached to opposite sidewalls of the container by the extended portions of the legs of the U shape so that bar connecting between the respective legs pivots over said hinging lid of said container, said U shaped locking bar being pivotal between a position which inhibits the opening of said lid, and a position which does not inhibit the opening of said lid;

a foot piece which engages the underlying surface supporting said container when said container is resting on said surface, said foot piece being urged against said surface by a spring means;

linkage means connecting between said locking bar and said foot piece means; wherein, when said container is lifted off of said surface, said foot piece is urged away from said container by said spring means which in turn translates said linkage means and rotates said locking bar to said position which does not inhibit opening of said lid.

2. A locking mechanism as in claim 1, further comprising:

removable locking means for selectively connecting and disconnecting said linkage means to said locking bar means.

3. An automatic pivoting locking mechanism for a dumpster container having a bottom supported by an underlying surface and a top with a hinging lid, said locking mechanism comprising:

an L shaped locking bar pivotally attached to a sidewall of the container and having one leg of the L shape pivots over said hinging lid of said container, said L shaped locking bar being pivotal between a position which inhibits the opening of said lid, and a position which does not inhibit the opening of said lid;

a foot piece which engages the underlying surface supporting said container when said container is resting on said surface, said foot piece being urged against said surface by a spring means;

linkage means connecting between said locking bar and said foot piece means; wherein, when said container is lifted off of said surface, said foot piece is urged away from said container by said spring means which in turn translates said linkage means and rotates said locking bar to said position which does not inhibit opening of said lid.

4. A locking assembly as in claim 3, further comprising:

removable locking means for selectively connecting and disconnecting said linkage means from said locking bar.

5. An automatic pivoting locking mechanism for a dumpster container having a bottom supported by an underlying surface and a top with a hinging lid, said locking mechanism a U shaped locking bar pivotally attached to opposite sidewalls of the container by the extended portions of the legs of the U shape so that bar connecting between the respective legs pivots over said hinging lid of said container, said U shaped locking bar being pivotal between a position which inhibits the opening of said lid, and a position which does not inhibit the opening of said lid;

a foot piece which engages the underlying surface supporting said container when said container is resting on said surface, said foot piece being urged against said surface by virtue of gravity acting on said foot piece;

linkage means connecting between said locking bar and said foot piece means; wherein, when said container is lifted off of said surface, said foot piece is urged away from said container by gravity which in turn translates said linkage means and rotates said locking bar to said position which does not inhibit opening of said lid.

6. A locking mechanism as in claim 5, further comprising:

removable locking means for selectively connecting and disconnecting said linkage means to said locking bar means.

7. An automatic pivoting locking mechanism for a dumpster container having a bottom supported by an underlying surface and a top with a hinging lid, said locking mechanism comprising:

an L shaped locking bar pivotally attached to a sidewall of the container and having one leg of the L shape pivots over said hinging lid of said container, said L shaped locking bar being pivotal between a position which inhibits the opening of said lid, and a position which does not inhibit the opening of said lid;

a foot piece which engages the underlying surface supporting said container when said container is resting on said surface, said foot piece being urged against said surface by gravity acting on said foot piece means;

linkage means connecting between said locking bar and said foot piece means; wherein, when said container is lifted off of said surface, said foot piece is urged away from said container by gravity which in turn translates said linkage means and rotates said locking bar to said position which does not inhibit opening of said lid.

8. A locking assembly as in claim 7, further comprising:

removable locking means for selectively connecting and disconnecting said linkage means from said locking bar.

* * * * *